US006570305B1

(12) United States Patent
Urayama et al.

(10) Patent No.: US 6,570,305 B1
(45) Date of Patent: May 27, 2003

(54) FIELD EMISSION ELECTRON SOURCE AND FABRICATION PROCESS THEREOF

(75) Inventors: Masao Urayama, Misato (JP); Keiichiro Uda, Kyoto (JP); Seiki Yano, Yamatokoriyama (JP); Yoshio Inoue, Akishima (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/339,226

(22) Filed: Jun. 24, 1999

(30) Foreign Application Priority Data

Jun. 30, 1998 (JP) ..... 10-184016

(51) Int. Cl.[7] ..... H01J 1/02

(52) U.S. Cl. ..... 313/311; 313/309; 313/495; 313/336; 313/351

(58) Field of Search ..... 313/309, 310, 313/311, 336, 351, 346 R, 495

(56) References Cited

U.S. PATENT DOCUMENTS

| | | | | |
|---|---|---|---|---|
| 4,766,340 A | * | 8/1988 | van der Mast et al. | 313/309 X |
| 5,038,070 A | | 8/1991 | Bardai et al. | |
| 5,150,192 A | * | 9/1992 | Greene et al. | 313/309 X |
| 5,747,926 A | * | 5/1998 | Nakamoto et al. | 313/495 |
| 5,786,656 A | * | 7/1998 | Hasegawa et al. | 313/308 |
| 5,836,796 A | * | 11/1998 | Danroc | 313/309 X |
| 5,847,496 A | * | 12/1998 | Nakamoto et al. | 313/336 |

FOREIGN PATENT DOCUMENTS

| | | |
|---|---|---|
| JP | 5121471 | 2/1976 |
| JP | 3220337 A | 9/1991 |
| JP | 4332423 A | 11/1992 |
| JP | 594762 A | 4/1993 |
| JP | 5274998 A | 10/1993 |
| JP | 8148083 A | 6/1996 |
| JP | 2718144 B2 | 11/1997 |
| JP | 2774155 B2 | 4/1998 |

OTHER PUBLICATIONS

"Field Emission from ZrC Films on Si and Mo Single Emitters and Emitter Arrays," J. Vac. Sci. Technol. B 14(3), pp. 2090–2092 (1996).

* cited by examiner

*Primary Examiner*—Vip Patel
*Assistant Examiner*—Joseph Williams
(74) *Attorney, Agent, or Firm*—Birch, Stewart, Kolasch & Birch, LLP

(57) ABSTRACT

A silicon substrate is used as the substrate, on which a conical projection is formed as a cathode. A gate electrode is arranged via an insulating film formed on the substrate. The gate electrode is formed so as to enclose and encircle the cathode while the pointed portion of the cathode and the surface of the gate electrode are coated with two layered coating films.

2 Claims, 7 Drawing Sheets

FIELD EMISSION ELECTRON SOURCE AND FABRICATION PROCESS THEREOF

BACKGROUND OF THE INVENTION (1) Field of the Invention

The present invention relates to a field emission electron source for emitting electrons from the cathode as well as relating to a fabrication process thereof. Detailedly, the invention relates to a field emission electron source which enables a low voltage, heavy current, stable configuration as well as relating to a fabrication process thereof.

(2) Description of the Prior Art

Recently, there has been marked progress in the fabrication technology for field emission electron sources that emit electrons in a high electric field, with the development of micro fabrication technology used in the field of integrated circuits or thin films. In particular, field emission electron source devices having highly miniaturized, field emission cold cathodes have been proposed. The emission field cold cathode of this type of electron source device is a most essential electron emission device, being one of the main parts constituting a micro-miniature electron tube of a triode type or micro- miniature electron gun.

FIGS. 1A to 1F show a fabrication method of a typical field emission electron source, which is disclosed, in Japanese Patent Application Laid-Open Hei 5 No.94,762.

First, an n-Si substrate 11 is thermally oxidized forming an ioxide film 15 on the surface thereof (FIG. 1A). Then, a circular cap 15*a* is formed after a photo process (FIG. 1B). When this substrate with the cap is dry etched, substrate 11 is etched with the portion beneath cap 15 being eroded from the underside so that a conical Si projection 11*a* is formed (FIG. 1C). Then, the substrate in this condition is thermally oxidized again forming an oxide film 12*a* (FIG. 1D). This oxide film 12*a* finally serves as an insulating film 12 between a cathode 10 and a gate 13 and also functions to keep the tip pointed. Next, gate electrode 13 is formed by oblique vapor deposition rotating around axis of rotation 16 (FIG. 1E), then the silicon oxide is etched by hydrofluoric acid to remove cap 15*a* and expose cathode tip 10 to thereby complete the intended field emission electron source (FIG. 1F).

FIG. 2 is an operational circuit diagram for operating this device. In a vacuum, an anode electrode 9 is arranged over cathode 10 of this field emission electron source with voltages applied between cathode 10 and gate 13 and between cathode 10 and anode 9. By this arrangement, the electric field between cathode 10 and gate 13 concentrates upon the pointed cathode end, causing cathode 10 to emit electrons forming a emitter portion, whereby electrons are drawn into the vacuum by the field emission tunnel effect.

These devices are very unstable at present, so that the obtainable current is low. If a large current is attempted, an excessive current flows through the cathode, finally, explosive meltdown and hence destruction could occur from Joule heat.

As an improvement against this, Japanese Patent Application Laid-Open Hei 3 No.220,337 offers deposition of a chemically stable, resistive material over the cathode surface. This method permits low voltage operation. However, if a heavy current is tried, the resistance of the resistive material generates heat so that there is a fear that the cathode tip's temperature be raised and a meltdown occur. Therefore, this method involves a risk of the device being destroyed, resulting in unsuitability as a heavy-current device.

Japanese Patent Application Laid-Open Hei 5 No.274,998 has proposed formation of a gold thin film over the cathode tip surface using a focused ion beam. This method, however, needs large-scale equipment for generating the focused ion beam. Further, use of a precious metal such as gold sharply raises the fabrication cost of the device, making it difficult to realize a low-cost device.

U.S. Pat. No. 5,038,070 discloses a configuration shown in FIG. 3, in which three layers of metal films 51, 52 and 53 form cathodes 54 with hollows 55 therein. For fabrication, the three layers of metal films are formed on a substrate having concavities and then the substrate is removed to thereby form projections of the metal films. However, since the cathode is formed of thin films, even though it is of three layers, there is a concern that the pointed end of the cathode would rise in temperature and melt down if a heavy current flows. Therefore, this method also has a risk of the device being destroyed, resulting in unsuitability as a heavy-current device.

SUMMARY OF THE INVENTION

The present invention has been devised in order to solve the above problems and it is therefore an object of the present invention to provide a stable, field emission electron source and a fabrication method thereof, wherein a heavy current can be assured with a low voltage, by coating the cathode tip by inexpensive, physical vapor deposition or sputtering vapor deposition.

In order to achieve the above object, the present invention is configured as follows:

In accordance with the first aspect of the present invention, a field emission electron source comprises:

a cathode made up of a substrate for emitting electrons;

a gate electrode for drawing electrons from the cathode; and an insulating film for insulating the gate electrode and the cathode, and is characterized in that a metallic material having a lower resistance than that of the cathode substrate is coated as the first layer over the substrate surface, and then another material having a lower work function than that of the substrate is coated as the second layer over the surface of the first layer of metallic material.

In accordance with the second aspect of the present invention, the field emission electron source having the above first feature is characterized in that at least one selected from Mo, W, Ta, Nb, Hf, Zr and Ti is used as the first layer of metallic material and as least one selected from HfC, ZrC and TiC is used as the second layer of material having a low work function is used.

In accordance with the third aspect of the present invention, the field emission electron source having the above first feature is characterized in that the first layer of metallic material is formed with a film thickness of 5 nm or more.

In accordance with the fourth aspect of the present invention, the field emission electron source having the above second feature is characterized in that the first layer of metallic material is formed with a film thickness of 5 nm or more.

In accordance with the fifth aspect of the present invention, the field emission electron source having the above first feature is characterized in that the second layer of material having a low work function is formed with a film thickness of 3 nm or more.

In accordance with the sixth aspect of the present invention, the field emission electron source having the above second feature is characterized in that the second layer of material having a low work function is formed with a film thickness of 3 nm or more.

In accordance with the seventh aspect of the present invention, the field emission electron source having the above third feature is characterized in that the total film thickness of the first layer of metal material and the second layer of material having a low work function is equal to or smaller than 30 nm.

In accordance with the eighth aspect of the present invention, the field emission electron source having the above fourth feature is characterized in that the total film thickness of the first layer of metal material and the second layer of material having a low work function is equal to or smaller than 30 nm.

In accordance with the ninth aspect of the present invention, the field emission electron having the above fifth feature is characterized in that the total film thickness of the first layer of metal material and the second layer of material having a low work function is equal to or smaller than 30 nm.

In accordance with the tenth aspect of the present invention, the field emission electron source having the above sixth feature is characterized in that the total film thickness of the first layer of metal material and the second layer of material having a low work function is equal to or smaller than 30 nm.

In accordance with the eleventh aspect of the present invention, a fabrication method of a field emission electron source comprising: a cathode made up of a substrate for emitting electrons; a gate electrode for drawing electrons from the cathode; and an insulating film for insulating the gate electrode and the cathode, comprises the steps of:

coating a first layer of metallic material having a lower resistance than that of the cathode substrate, over the substrate surface; and coating a second layer of material having a lower work function than that of the substrate, over the surface of the first layer of metallic material, wherein the first layer of metallic material and second layer of material having a low work function are deposited by precisely directional film forming methods.

In accordance with the twelfth aspect of the present invention, a fabrication method of a field emission electron source comprising: a cathode made up of a substrate for emitting electrons; a gate electrode for drawing electrons from the cathode; and an insulating film for insulating the gate electrode and the cathode, comprises the steps of:

coating a first layer of metallic material having a lower resistance than that of the cathode substrate, over the substrate surface; and coating a second layer of material having a lower work function than that of the substrate, over the surface of the first layer of metallic material, wherein the first layer of metallic material and the second layer of material having a low work function are successively coated in the same vacuum.

In accordance with the thirteenth aspect of the present invention, the fabrication method of a field emission electron source having the above eleventh feature is characterized in that in the step of coating the first layer of metallic material and in the subsequent steps, silicon as the cathode substrate and the metallic material are inhibited from reacting with each other.

In accordance with the fourteenth aspect of the present invention, the fabrication method of a field emission electron source having the above twelfth feature is characterized in that in the step of coating the first layer of metallic material and in the subsequent steps, silicon as the cathode substrate and the metallic material are inhibited from reacting with each other.

In accordance with the fifteenth aspect of the present invention, the fabrication method.of a field emission electron source having the above thirteenth feature is characterized in that when the first layer of metallic material uses Mo, the film of the first layer of metallic material is formed at a temperature equal to or below 500° C.

In accordance with the sixteenth aspect of the present invention, the fabrication method of a field emission electron source having the above fourteenth feature is characterized in that when the first layer of metallic material uses Mo, the film of the first layer of metallic material is formed at a temperature equal to or below 500° C.

In accordance with the seventeenth aspect of the present invention, the fabrication method of a field emission electron source having the above thirteenth feature is characterized in that when the first layer of metallic material uses W, Ta or Nb, the film of the first layer of metallic material is formed at a temperature equal to or below 650° C.

In accordance with the eighteenth aspect of the present invention, the fabrication method of a field emission electron source having the above fourteenth feature is characterized in that when the first layer of metallic material uses W, Ta or Nb, the film of the first layer of metallic material is formed at a temperature equal to or below 650° C.

In accordance with the nineteenth aspect of the present invention, the fabrication method of a field emission electron source having the above thirteenth feature is characterized in that when the first layer of metallic material uses Hf, the film of the first layer of metallic material is formed at a temperature equal to or below 750° C.

In accordance with the twentieth aspect of the present invention, the fabrication method of a field emission electron source having the above fourteenth feature is characterized in that when the first layer of metallic material uses Hf, the film of the first layer of metallic material is formed at a temperature equal to or below 750° C.

In accordance with the twenty-first aspect of the present invention, the fabrication method of a field emission electron source having the above thirteenth feature is characterized in that when the first layer of metallic material uses Zr, the film of the first layer of metallic material is formed at a temperature equal to or below 700° C.

In accordance with the twenty-second aspect of the present invention, the fabrication method of a field emission electron source having the above fourteenth feature is characterized in that when the first layer of metallic material uses Zr, the film of the first layer of metallic material is formed at a temperature equal to or below 700° C.

In accordance with the twenty-third aspect of the present invention, the fabrication method of a field emission electron source having the above thirteenth feature is characterized in that when the first layer of metallic material uses Ti, the film of the first layer of metallic material is formed at a temperature equal to or below 600° C.

In accordance with the twenty-fourth aspect of the present invention, the fabrication method of a field emission electron source having the above fourteenth feature is characterized in that when the first layer of metallic material uses Ti, the film of the first layer of metallic material is formed at a temperature equal to or below 600° C.

DESCRIPTION OF THE PREFERRED EMBODIMENTS

The embodiment of the present invention will hereinafter be described with reference to the accompanying drawings.

The First Embodiment

Figure 1A:
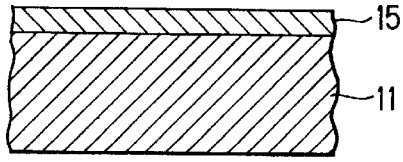
FIG. 1A PRIOR ART
FIGS. 1A to 1F are procedural diagrams showing the fabrication method of a conventional field emission electron source.
Figure 1B:
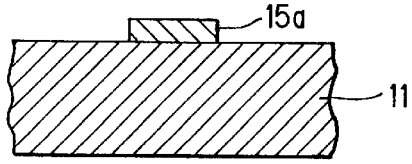
FIG. 1B PRIOR ART
Figure 1C:
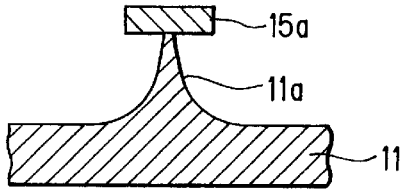
FIG. 1C PRIOR ART
Figure 1D:
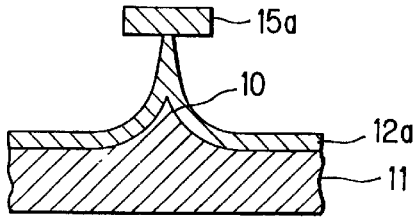
FIG. 1D PRIOR ART
Figure 1E:
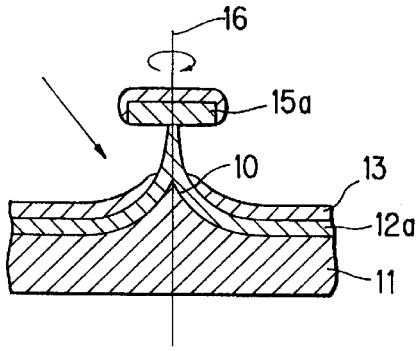
FIG. 1E PRIOR ART
Figure 1F:
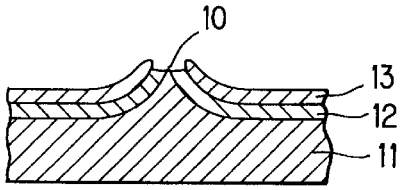
FIG. 1F PRIOR ART
Figure 2:
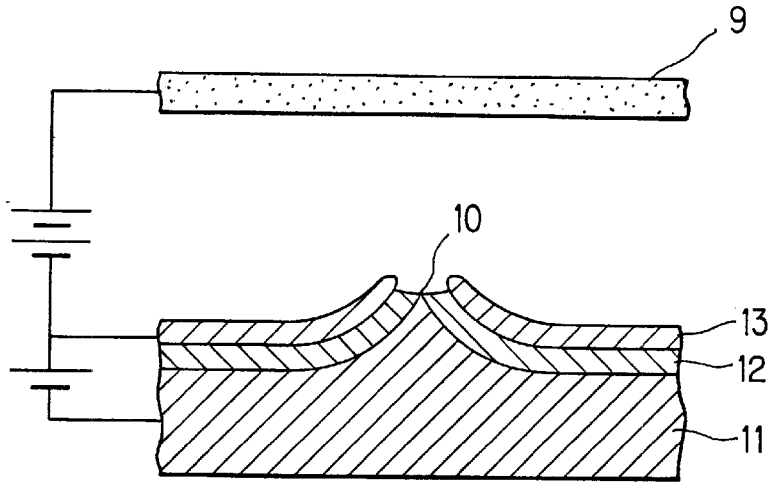
FIG. 2 PRIOR ART
FIG. 2 is an operational circuit diagram for operating the above conventional field emission electron source.
Figure 3:
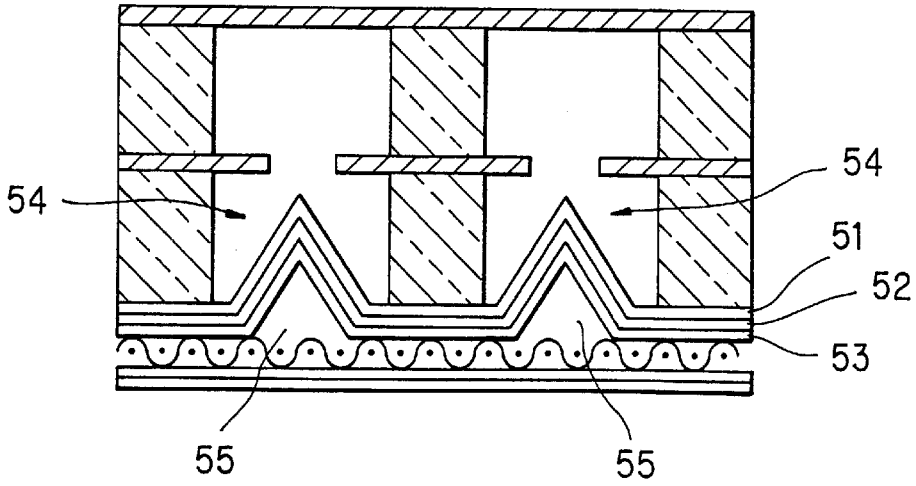
FIG. 3 PRIOR ART
FIG. 3 is a configurational view showing another conventional field emission electron source.
Figure 4:
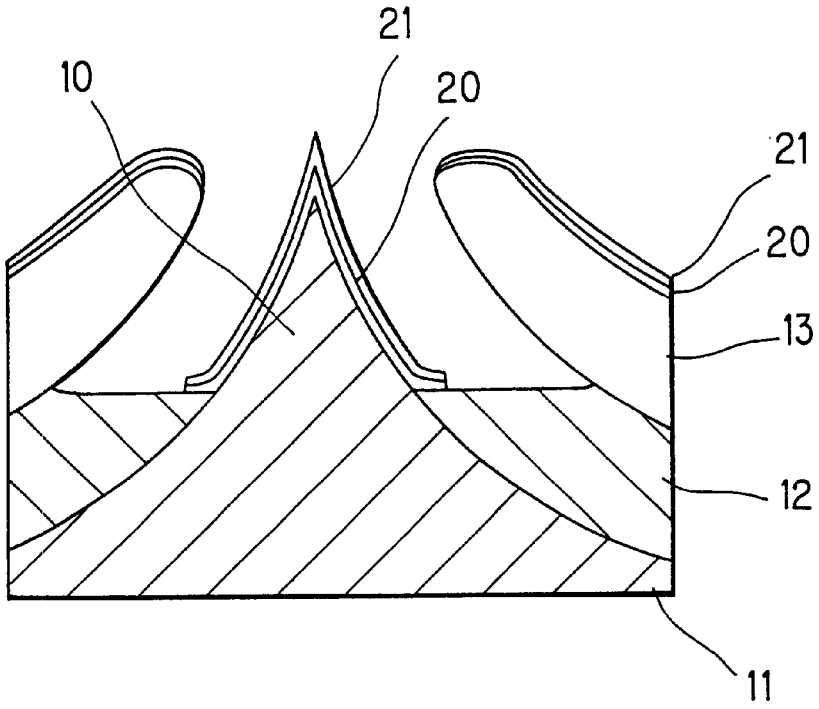
FIG. 4 is a sectional view showing the first embodiment of a field emission electron source in accordance with the present invention.

FIG. 4 is a sectional view showing the first embodiment of a field emission electron source in accordance with the present invention; and FIGS. 5A to 5H are procedural diagrams showing the fabrication method of this field emission electron source. As shown in FIG. 4, this field emission electron source is configured of a cathode 10, a substrate 11, an insulating film 12, a gate 13 and coating layers 20 and 21. Since this has almost the same structure as the conventional configuration shown in FIGS. 1A to 1F, the same components are allotted with the same reference numerals. Substrate 11 is formed of a silicon substrate. As cathode 10, a conical projection is formed on substrate 11. Gate electrode 13 is arranged on substrate 11 with insulating film 12 in between. Gate electrode 13 is formed so as to enclose and encircle cathode 10 while the surface of the pointed portion of cathode 10 and the surface of gate electrode 13 are coated with two coating layers 20 and 21.

Referring next to FIGS. 5A to 5H, the fabrication method of this device will be described.

Figure 5A:
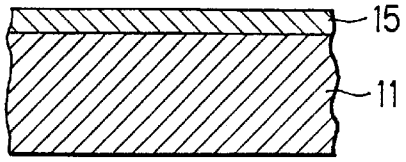
FIGS. 5A to 5H are procedural diagrams showing the fabrication method of a field emission electron source in accordance with the present invention.

After rinsing n-type Si substrate 11, an oxide film 15 is formed using heat-oxidation oven (FIG. 5A). Since this thermal oxide film 15 has a masking function for subsequent silicon etching, it is impossible to maintain physical strength if it is too thin. At least 2,000 Å or more is needed. In this case, a thermal oxide film 15 of 3,000 Å thick was formed by using wet oxidation process keeping the substrate at 1,100° C. for 22 minutes.

Figure 5B:
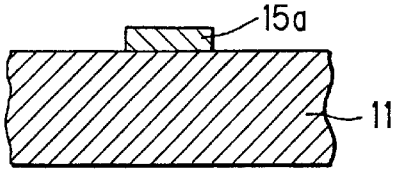

Next, a masking pattern is formed on the obtained oxide film 15 by a normal photo process. Then, the mask is used to pattern thermal oxide film 15 by etching to transfer the same pattern to thermal oxide film 15, forming an etching mask 15*a* (to be referred to as cap 15*a*) (FIG. 5B). Cap 15*a* may be formed with various shapes and dimensions depending on the etching shape to be needed. Since the shape and dimensions are dependent upon the conditions of silicon etching in the subsequent step, it is always necessary to determine them taking into account the balance between them and the silicon etching. In the present invention, a circular pattern having a diameter of 3 $\mu$m was used.

Etching methods of silicon oxide are roughly categorized into two types, i.e., wet and dry types. In this case, RIE (reactive ion etching) technique as one of the drying etching techniques was used. The etching gas was $CHF_3$. The etching process was implemented at a vacuum of 50 mTorr with a gas flow rate of 30 sccm and an etching power of 500 W. Etching needs to be implemented until $SiO_2$ is completely removed. In this embodiment, it took 19 minutes for completion.

Figure 5C:
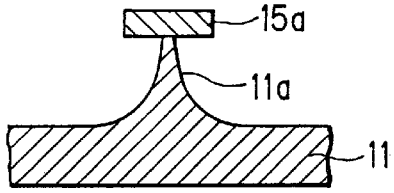

Next, silicon of substrate 11 is isotropically etched so as to form a conical shape 11*a* as a base form of a cathode (FIG. 5C). Etching was implemented by the same method as used for silicon oxide, i.e., RIE (reactive ion etching). This etching was performed at a vacuum of 100 mTorr, with a gas flow rate of 100 sccm and an etching power 100 W. Etching was finished so that the Si neck beneath silicon oxide cap 15*a* became 0.6 $\mu$m in diameter.

Figure 5D:
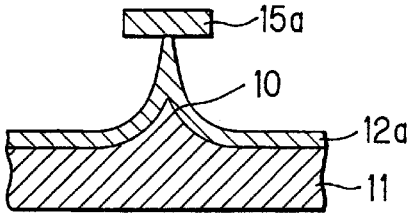

Next, the surface of the silicon thus etched was thermally oxidized in order to produce an insulating film 12 between the gate and cathode (FIG. 5D). The oxidation was implemented in the same conditions as for the oxidation of FIG. 5A, at 1,100° C. for 34 minutes to form a thermal oxide film 12*a* of 4,000 Å thick. This oxide film 12*a* is formed in order to provide the function of an insulating film between gate 13 and cathode 10. However, from a processing viewpoint, this significantly affects the tip shape, in particular, the tip diameter and the height of the cathode 10 tip relative to gate electrode 13. Therefore, it is necessary to comprehensively set the conditions, by taking into account the combinations of the silicon etching shape and the positional relationship between the gate edge and cathode tip, determined by the gate deposition angle. In the current embodiment, this oxidation was implemented under the above conditions taking into account these requirements.

Figure 5E:
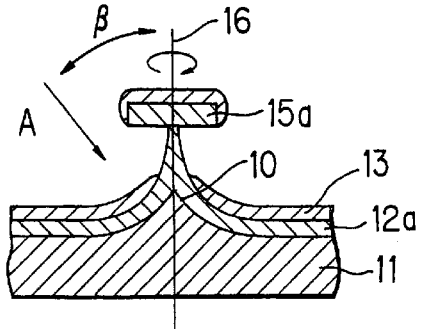

Next, gate electrode 13 is rotationally and obliquely deposited around axis of rotation 16 (FIG. 5E). The vapor deposition angle is determined so that the final cathode tip is approximately as high as the upper end of the gate electrode or cathode 10 is slightly higher. This is because if the tip of cathode 10 is lower than gate electrode 13, many of electrons emitted from the cathode tip enter gate 13 (increasing the gate current) and hence the anode current lowers. At the same time, since electrons sputtering on a gate electrode 13 release gases therefrom, which leads to vacuum reduction and consequently the risk of the device being destroyed. In this current example, Nb was vapor deposited with an angle $\beta$ of 55 degrees with respect to Si substrate 11. The film may be formed of any other typical electrode material other than this as long as it functions as an electrode. The method of vapor deposition was used for film forming in this example because a method which causes as low a wraparound as possible was preferred when using silicon oxide cap 15*a* as a shade. However, film forming does not need to be limited to this as long as the same effect can be expected.

Figure 5F:
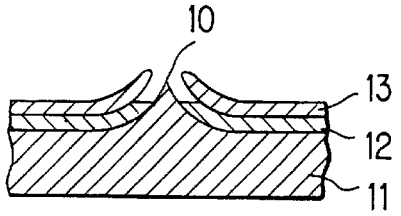

Next, the substrate is treated with BHF for about 10 minutes so as to remove cap 15*a* (FIG. 5F). In this treatment, in addition to removal of cap 15*a*, it is also necessary to remove gate insulating film 12*a* of silicon oxide to a necessary and sufficient depth so as to expose cathode 10 and further prevent short-circuit between gate 13 and cathode 10 when cathode 10 is coated. Nevertheless, too a long treatment will cause a risk of the adhesion between gate 13 and silicon oxide 12*a* being weakened. In this embodiment, this treatment was implemented under the condition, i.e., the time indicated above, which allowed removal near to the emitter base, but this should not limit the invention. This condition may be determined taking into account the coating material, gate electrode material, or the total device configuration.

Figure 5G:
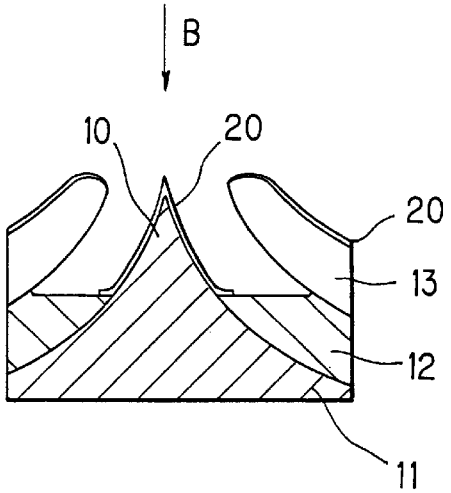
Figure 5H:
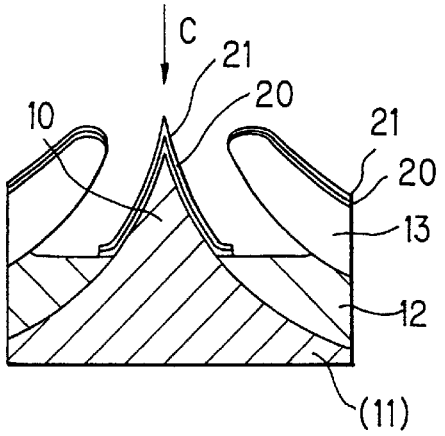

Next, two layers are coated on cathode 10 (FIGS. 5G and 5H). The purpose of this coating is to provide coat material having a lower work function than that of the cathode material (silicon in this embodiment), for securing low voltage with a heavy emission current. Since the work function of silicon is 4.3 eV, a material having a work function lower than this needs to be coated. For this purpose, a metal material having a resistance lower than the cathode material (silicon) is coated as the first, backing layer (FIG. 5G), and then the second layer is coated over the first layer (FIG. 5H). The second layer is the aforementioned material having a low work function.

It is important to determine the film forming conditions for first layer 20 in such a manner that the first layer functions to assist in lowering the work function of the second layer film which will be in contact with the vacuum in the finished state. This principle has not been fully understood but the backing layer is considered to produce some effects.

Since from the viewpoint of the cathode tip shape, the reaction between the deposition metal and silicon needs to be inhibited, it is important to effect film forming at a temperature which will not cause a reaction with silicon. Table 1 below presents the temperatures at which silicon and metals react forming their suicides. This is a part of a table inserted on p.378 of THIN FILM—INTERDIFFUSION AND REACTIONS (Author POATE, TU & MAYER, publisher: WILEY INTERSCIENCE). Therefore, the film forming temperature for each metal needs to be set lower than the corresponding temperature.

Such coating facilitates easy and mass production at a low cost, of devices having a high electric conductivity and a high thermal resistance when using a silicon process.

TABLE 1

| Silicide | Formation temperature (° C.) |
|---|---|
| $TiSi_2$ | 600 |
| $ZrSi_2$ | 700 |
| $HfSi_2$ | 750 |
| $VSi_2$ | 600 |
| $NbSi_2$ | 650 |
| $TaSi_2$ | 650 |
| $CrSi_2$ | 450 |
| $MoSi_2$ | 525 |
| $WSi_2$ | 650 |
| $NiSi_2$ | 750 |
| $CoSi_2$ | 550 |
| $FeSi_2$ | 550 |
| $MnSi_2$ | 800 |

Next, the results obtained by using a variety of materials for the coating treatment of two layers 20 and 21 will be presented.

(1) THE FIRST EXAMPLE

Aiming at providing a device having high merit as a whole, the first example was effected in which Mo metal was used for the first layer to form a film of 10 nm thick by EB vapor deposition. The film forming was performed at a film forming rate of 0.2 nm/sec, at a substrate temperature of 200° C. under a vacuum of $5\times10^{-6}$ torr.

Figure 6:
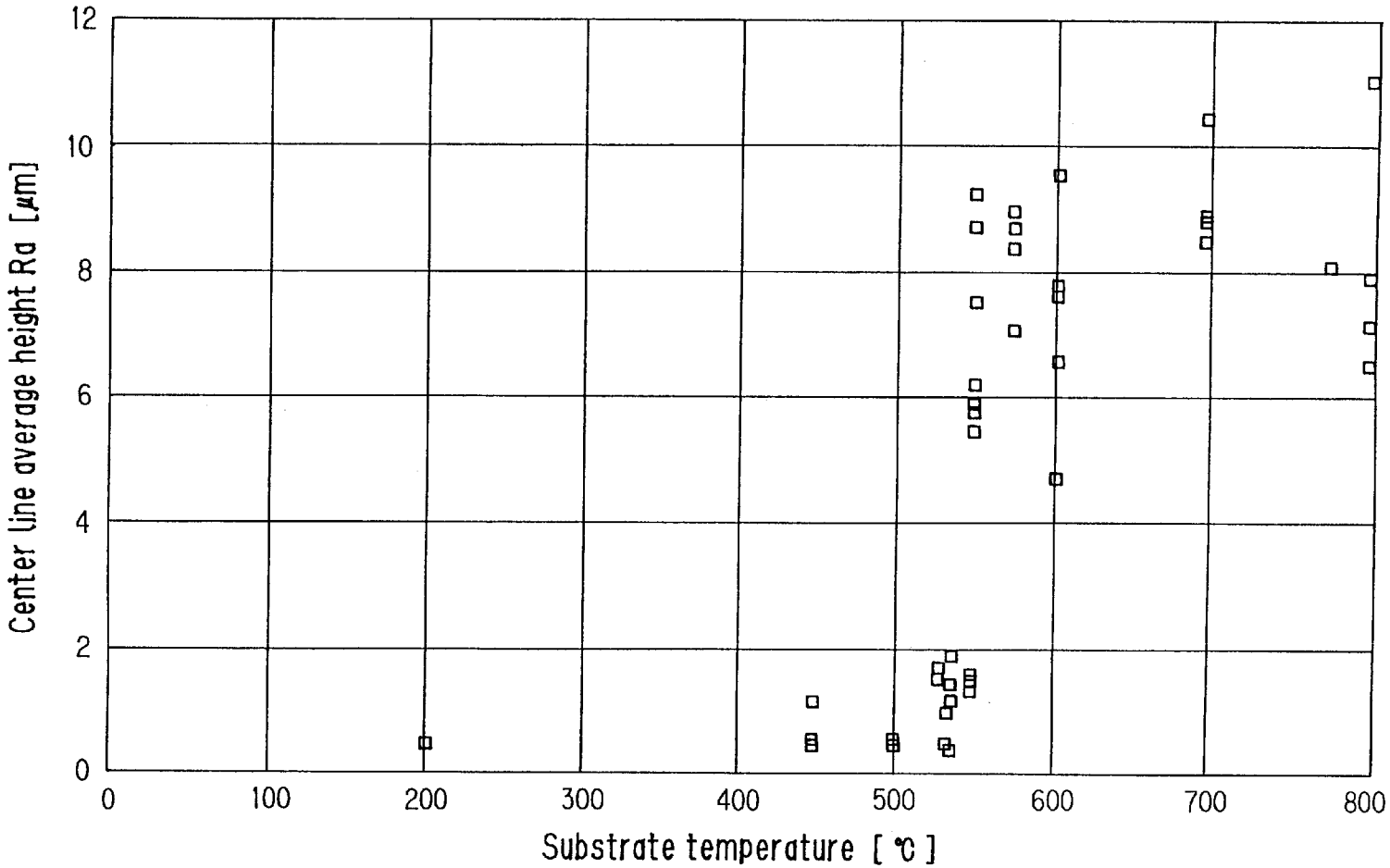
FIG. 6 is a chart showing the dependency of the center line average height of the Mo forming surface upon the substrate temperature.

FIG. 6 shows the dependency of the average height of the Mo forming surface upon the substrate temperature, measured by an AFM (atomic force microscope) when a Mo film of 10 nm thick was formed on silicon. From this chart, the center line average height Ra of the surface sharply increases at a film forming temperature of 550° C. or above. From the result of XRD (X-ray diffraction analysis), it was understood that Mo silicides were formed by the reaction between Mo and Si. Since the preferable radius of curvature of the tip of cathode 10 for emitting electrons are about 10 nm, it should be understood that the above result enlarges the fluctuation of the radius of curvature of the tip of cathode 10. For producing an electron emitter based on the original design, it is necessary to inhibit the deposition metal and silicon from reacting from the viewpoint of the cathode tip shape. Therefore, the forming temperature in this example was set at 200° C.

The second layer 21 used HfC which will mutually react with the Mo used in the backing layer. The film was formed by EB vapor deposition with a film thickness of 3 nm so that the film and the Mo backing layer were allowed to affect each other. The film was formed at a film forming rate of 0.25 nm/sec, at a substrate temperature of 200° C. under a vacuum of $5\times10^{-6}$ torr.

Figure 7:
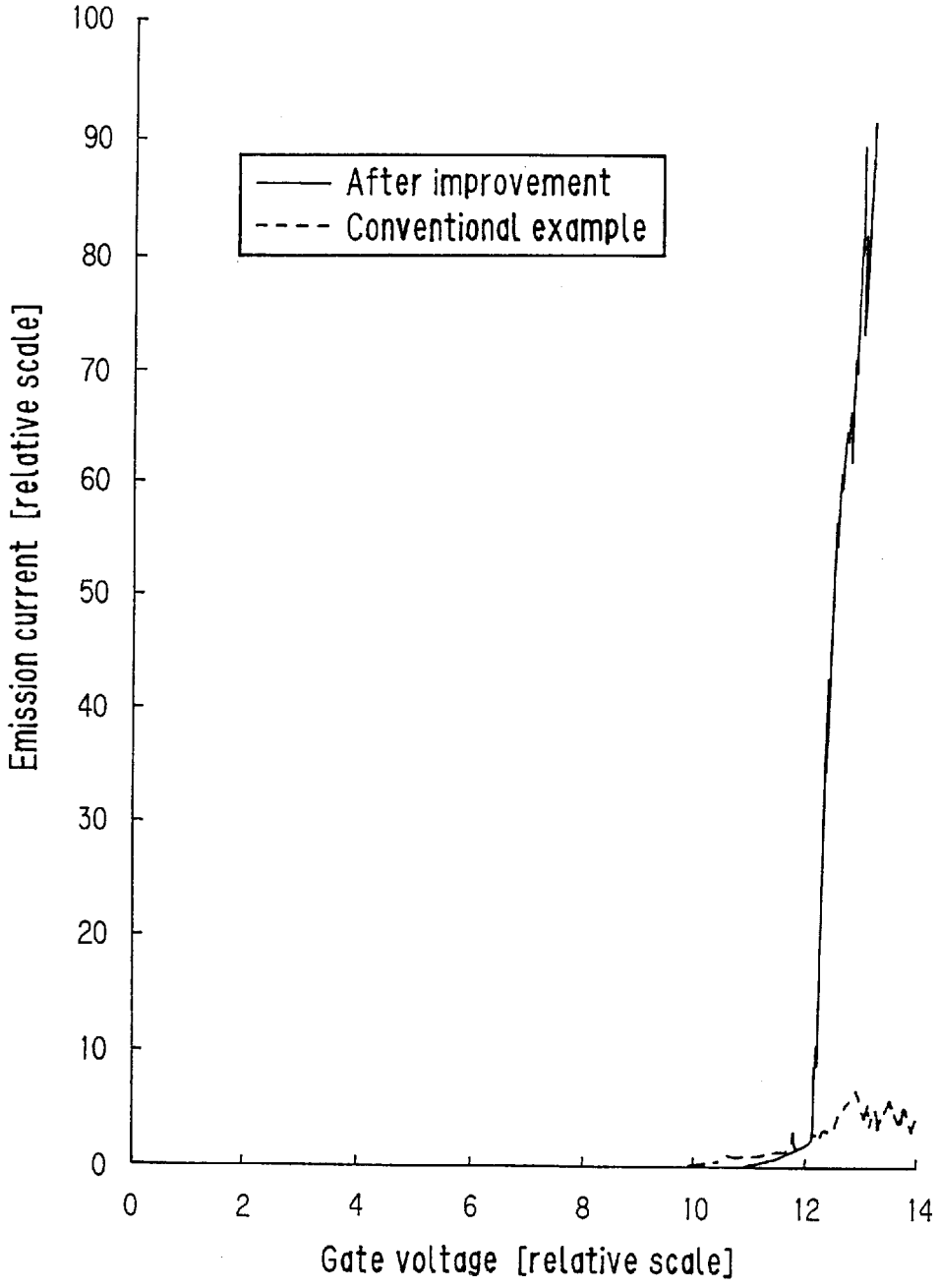
FIG. 7 is a chart showing the current characteristic of an electron source of the present invention compared with that of a conventional silicon emitter with no surface coating.

The device thus formed was set under a ultra-high vacuum ($5\times10^{-9}$ torr) and the emission current was measured in a triode arrangement. FIG. 7 shows the current characteristics of this electron source compared with that of a conventional silicon emitter with no surface coating. The emission current at 130 V was about 25 $\mu$A in the conventional electron source whereas it could be sharply improved to about 400 $\mu$A in this example.

The effective work function $\Phi$ determined based on the obtained F-N curve and the diameter at the device tip measured by a high-resolution electron microscope was 2.8 eV ($\Phi$=2.8 eV) with the tip diameter of 9 nm. That is, the work function $\Phi$ could be reduced from 4.3 eV to 2.8 eV. From the analysis, of the thin film produced under the same conditions, by RHEED (reflection high energy electron diffraction) and XRD, it is believed that this advantage was obtained by the formation of microcrystals of Mo deposited on silicon and the formation of HfC crystal lattices deposited thereon.

In this example, the thickness of the Mo film deposited on the silicon cathode was set at 10 nm and the thickness of the HfC film deposited on the Mo layer was set at 3 nm. This is because the electron emission characteristics are largely affected by the dimension of the radius of curvature of the cathode. Explicitly, a smaller radius of curvature of the cathode tip is preferable to lower the operating voltage. In this respect, the total thickness of the deposition layers was set at 13 nm in order to inhibit increase in the radius due to deposition to as low as possible. With a deposition of 13 nm, the radius of curvature at the cathode tip increased from about 7 nm to 9 nm. It was confirmed by another investigation that the same characteristics could be obtained when the Mo and HfC layers were thinned to 5 nm and 3 nm, respectively. Though the film forming temperature was set at 200° C., it was confirmed that almost the same improvement in emission current characteristics shown in FIG. 7 could be obtained when film forming was effected at temperatures from room temperature to 500° C.

(2) THE SECOND EXAMPLE

In this second example, a Mo coated silicon emitter shown in FIG. 5G was prepared in the same manner as the first example and then a film of ZrC which belongs to the same group as HfC was formed with a thickness of 3 nm as the second layer. The film was formed at a film forming rate of 0.25 nm/sec, at a substrate temperature of 200° C. under a vacuum of $4\times10^{-6}$ torr.

The device thus formed was set under a ultra-high vacuum ($5\times10^{-9}$ torr) and the emission current was measured in a triode arrangement. With a gate voltage of 100 V, a current exceeding 100 $\mu$A was confirmed. The effective work function $\Phi$ determined based on the obtained F-N curve and the diameter at the device tip measured by a high-resolution electron microscope was 2.9 eV ($\Phi$=2.9 eV) with the tip diameter of 9 nm.

(3) THE THIRD EXAMPLE

In the third example, a silicon emitter shown in FIG. 5F was prepared in the same manner as the first example and then W instead of Mo was deposited as the first layer. Tungsten was selected because it belongs to the same group as Mo, has a relatively similar physical properties and hence is considered to have the same effects as Mo. In this example, a film of 10 nm was formed in the same manner by EB vapor deposition. The film was formed at a film forming rate of 0.2 nm/sec, at a substrate temperature of 200° C. under a vacuum of $5\times10^{-6}$ torr.

Then, a HfC film was formed of 3 nm thick as the second layer in the same manner as the first example. The film was formed at a film forming rate of 0.25 nm/sec, at a substrate temperature of 200° C. under a vacuum of $5\times10^{-6}$ torr. The device thus formed was set under a ultra-high vacuum ($5\times10^{-9}$ torr) and the emission current was measured in a triode arrangement. With a gate voltage of 100 V, a current exceeding 200 $\mu$A was confirmed. The effective work function $\Phi$ determined based on the obtained F-N curve and the diameter at the device tip measured by a high-resolution electron microscope was 2.8 eV ($\Phi$=2.8 eV) with the tip diameter of 9 nm.

(4) THE FOURTH EXAMPLE

In the fourth example, a W-coated silicon emitter shown in FIG. 5G was prepared in the same manner as the third example and then a film of ZrC which belongs to the same group was formed of 3 nm thick as the second layer. The film was formed at a film forming rate of 0.25 nm/sec, at a substrate temperature of 200° C. under a vacuum of $4\times10^{-6}$ torr. The device thus formed was set under a ultra-high vacuum ($5\times10^{-9}$ torr) and the emission current was measured in a triode arrangement. With a gate voltage of 100 V, a current exceeding 150 $\mu$A was confirmed. The effective work function $\Phi$ determined based on the obtained F-N curve and the diameter at the device tip measured by a high-resolution electron microscope was 3.0 eV ($\Phi$=3.0 eV) with the tip diameter of 9 nm.

Although no detailed description is given as to the first through fourth examples, the film thickness is 5 nm minimum for the first layer and 3 nm minimum for the second layer. Anything thinner than this cannot provide satisfactory characteristics. The total film thickness of the first and second layers is 30 nm maximum. Anything thicker than this can produce a large current because the diameter at the cathode tip is large but also will raise the gate voltage so that it cannot provide satisfactory characteristics.

The Second Embodiment

Figure 8A:
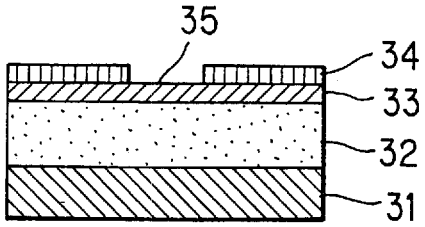
FIGS. 8A to 8G are sectional views showing the second embodiment of a field emission electron source in accordance with the present invention.

FIGS. 8A to 8G shows another emitter (cathode) having different configuration from the first embodiment. First, as shown in FIG. 8A, a Si substrate 31 was thermally oxidized forming a silicon oxide 32 of 1 $\mu$m thick as a gate insulating film. Then, Mo metal 33 was formed by EB vapor deposition to form a Mo film of 230 nm thick. Further, a resist 34 for patterning the arrangement of the gate electrode was applied over the substrate, which in turn is exposed to light and developed so as to from a circular pattern 35. The circle size was set at about 1 $\mu$m.

Here, although Si was used as substrate 31 in order to improve the work efficiency, it is also possible to use an insulative substrate such as a glass substrate etc., or other conductive substrates (metal etc.). In a case of an insulative substrate, a metal or conductive film should be formed first and then an insulative film (silicon oxide or the like) should be formed by EB film forming, sputtering or other methods. Then the same procedures can be done. In a case of a conductive substrate and when a gate insulating film 32 cannot be formed by thermal oxidation or similar techniques, an insulative film may be formed by a similar vacuum film forming technique.

Figure 8B:
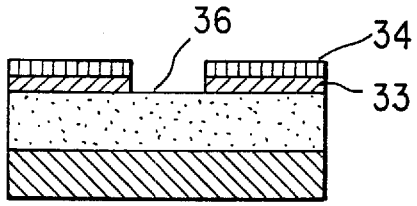
Figure 8C:
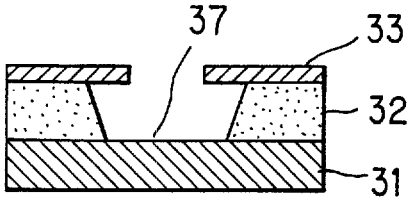
Figure 8D:
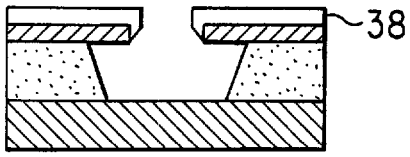
Figure 8E:
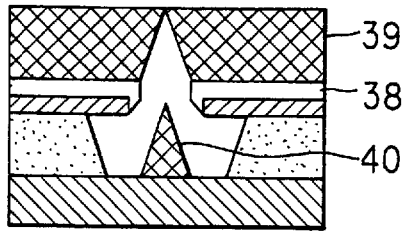

Next, Mo metal 33 is etched using a resist pattern 35 formed as above to produce a hollow 36 (FIG. 8B). This step may be carried out by any method as long as the circle of resist pattern 35 is transferred to Mo layer 33 in its original size. In this embodiment, RIE as one of dry etching techniques was used with a mixture gas of $CF_4/O_2$ with a gas flow rate of 20:20 sccm, under a pressure of 6.7 Pa, with an output power of 95 W for three minutes.

Next, resist 34 was removed by ashing, then gate insulating film 32 was etched by hydrofluoric acid to form a hollowed portion 37. In this step, since other than silicon oxide 32 will not be eaten so that the bottom will stop at the interface with Si portion 31. Also, Mo 32 forming the gate will not be eaten, so that hollowed portion 37 having the shape shown in FIG. 8C will be formed.

Next, in order to form 'eaves' projected over hollowed portion 37 in gate insulating film 32, an aluminum (Al) film 38 is formed by oblique EB vapor deposition. In particular, it is important to form the film at an angle at which Al will neither adhere to silicon oxide 32 nor silicon 31 inside hollowed portion 37. From this viewpoint, the film was formed of 300 nm thick at an angle of 15 degrees with the Mo 33 surface.

Next, an emitter cone 40 is formed by vacuum deposition from a direction perpendicular to this substrate. Mo was used as the emitter metal. The film was formed with a film thickness of 1.3 $\mu$m at a temperature of 200° C. The material for emitter cone 40 may be either semiconductor or conductor as long as it is basically conductive.

Figure 8F:
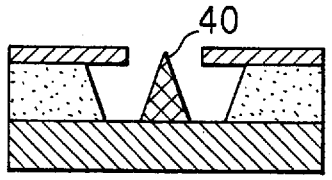
Figure 8G:
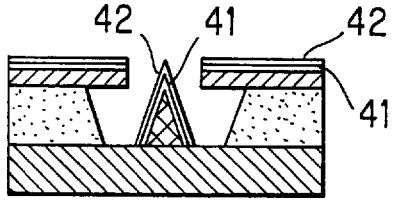

Next, Al layer 38 is dissolved by a lift-off method to remove Mo layer 39 which has adhered onto Al layer during formation of the emitter. In this embodiment, phosphoric acid was used as the etchant of Al layer 38. This completes the emitter base in which emitter cone 40 is exposed (FIG. 8F).

Subsequently, as in the third example, W is formed as the first layer 41 and then HfC is formed as the second layer 42. The conditions are the same as in the third example. The metal used as the first metal layer 41 may be the same as, or different from, that of emitter cone 40. The thus produced 1 tip device was set under a ultra-high vacuum and the emission current was measured in a triode arrangement. With a gate voltage of 100 V, a current exceeding 100 $\mu$A was obtained.

The diverse fabricating conditions and materials described in the above first and second embodiments are mere examples, hence any conditions and materials can be applied as long as the designed, intended shape or performance can be obtained. Further, even when an emitter which was not illustrated in the forgoing description is used, it is obvious that it is possible to fabricate a device having equivalent characteristics by constructing a film structure under the predetermined film forming conditions. In the above embodiments of the present invention, specific device configurations were described, but it is obvious from the content of the present invention that the invention can be applied to any field emission device that uses the tunnel effect obtained from electric field concentration.

In accordance with the first to eleventh features of the invention, two kinds of materials which mutually affect each other are coated over the cathode tip, so as to lower the work function, thereby enabling electron emission at a low voltage in a heavy current. Further, when the emitter of the present invention is applied to a device, it is possible to fabricate a triode capable of operating at a low voltage, in a field emission display, or other heavy-current devices.

In particular, in accordance with the third to tenth features of the invention, controlling the thickness of the coating films reduces the work function in the electron source, thus making it possible to achieve characteristics enabling electron emission at a low voltage in a heavy current.

In accordance with the eleventh feature of the invention, since the first and second layers are formed by a precisely directional, film forming technique, it is possible to efficiently produce the designated device at an improved yield without causing leaks which would have occurred due to the formation of a film between the gate electrode and the cathode.

In accordance with the twelfth feature of the invention, the first and second layers are successively formed by deposition in the same vacuum, so that there is no need to create a vacuum separately for the first and second layers, which leads to an improved productivity.

In accordance with the thirteenth to twenty-fourth features of the invention, since the temperatures and other conditions for forming metal films are selected so as to avoid reactions between silicon as the cathode base and the metal material, no silicide will be formed, which leads to stable device characteristics.

What is claimed is:

1. A field emission electron source comprising:

a cathode made up of a solid conical substrate for emitting electrons;

a gate electrode for drawing electrons from the cathode; and an insulating film for insulating the gate electrode and the cathode, wherein 5 nm or more of a metallic material having a lower resistance than that of the cathode substrate is coated as a first layer over the substrate surface, and then 3 nm or more of another material having a lower work function than that of the substrate is coated as a second layer over the surface of the first layer of metallic material, and wherein the total film thickness of the first layer of metal material and the second layer of material having a low work function is equal to or smaller than 30 nm.

2. The field emission electron source according to claim 1, wherein at least one metal selected from Mo W, Ta, Nb, Hf, Zr and Ti is used as the first layer of metallic material and at least one material selected from HfC, ZrC and TiC is used as the second layer of material having a low work function.

* * * * *